US005870955A

United States Patent [19]

Williams et al.

[11] Patent Number: 5,870,955

[45] Date of Patent: Feb. 16, 1999

[54] LITHOGRAPHIC PRINTING SYSTEM WITH REUSABLE SUPPORT SURFACES AND LITHOGRAPHIC CONSTRUCTIONS FOR USE THEREWITH

[75] Inventors: Richard A. Williams, Hampstead, N.H.; Ernest W. Ellis, Harvard, Mass.; Thomas E. Lewis, E. Hampstead, N.H.; Robert Howard, New York, N.Y.

[73] Assignee: Presstek, Inc., Hudson, N.H.

[21] Appl. No.: 812,382

[22] Filed: Mar. 5, 1997

[51] Int. Cl.[6] ..... B41C 1/10

[52] U.S. Cl. ..... 101/453; 101/460; 101/462; 101/467

[58] Field of Search ..... 101/378, 382.1, 101/383, 384, 415.1, 453–455, 457–460, 462, 463.1, 465–467; 430/300, 302, 945, 961

[56] References Cited

U.S. PATENT DOCUMENTS

| | | | |
|---|---|---|---|
| 2,060,082 | 11/1936 | Johnson et al. | 101/378 |
| 2,606,492 | 8/1952 | Black | 101/124 |
| 3,353,481 | 11/1967 | Antonucci | 101/93.3 |
| 4,005,653 | 2/1977 | Arkell | 101/389.1 |
| 4,056,057 | 11/1977 | Smith | 101/389.1 |
| 4,086,853 | 5/1978 | Figov et al. | 101/467 |
| 4,092,925 | 6/1978 | Fromson | 101/415.1 |
| 4,419,436 | 12/1983 | Kranser | 430/260 |
| 4,461,663 | 7/1984 | Tachibana et al. | 101/375 |
| 4,537,129 | 8/1985 | Heinemann et al. | 101/415.1 |
| 4,817,527 | 4/1989 | Wouch et al. | 101/389.1 |
| 4,856,428 | 8/1989 | Green et al. | 101/475 |
| 4,977,833 | 12/1990 | Image et al. | 101/415.1 |
| 5,085,907 | 2/1992 | Smith | 428/40 |
| 5,124,227 | 6/1992 | Hodgins et al. | 430/162 |
| 5,284,091 | 2/1994 | Kon et al. | 101/415.1 |
| 5,347,927 | 9/1994 | Berna et al. | 101/401.1 |
| 5,379,698 | 1/1995 | Nowak et al. | 101/454 |
| 5,402,721 | 4/1995 | Schultz | 101/389.1 |
| 5,440,987 | 8/1995 | Williams et al. | 101/454 |
| 5,493,971 | 2/1996 | Lewis et al. | 101/454 |

FOREIGN PATENT DOCUMENTS

| | | |
|---|---|---|
| 0 308 799 | 3/1989 | European Pat. Off. . |
| 644064 | 3/1995 | European Pat. Off. . |

*Primary Examiner*—Stephen R. Funk
*Attorney, Agent, or Firm*—Cesari and McKenna,LLP

[57] ABSTRACT

Lithographic printing constructions are removable from a permanent support, which may be a metal sheet affixable (usually by clamps) to a plate cylinder, or may instead be the permanent surface of such a cylinder. In this way, the traditional "plate" is replaced with a thin, easily manufactured printing member, which is separated from the support following its use.

6 Claims, 4 Drawing Sheets

LITHOGRAPHIC PRINTING SYSTEM WITH REUSABLE SUPPORT SURFACES AND LITHOGRAPHIC CONSTRUCTIONS FOR USE THEREWITH

BACKGROUND OF THE INVENTION

1. Field of the Invention

The present invention relates to digital printing apparatus and methods, and more particularly to lithographic printing plate constructions that may be imaged on- or off-press using digitally controlled laser output.

2. Description of the Related Art

In offset lithography, an image is present on a plate or mat as a pattern of ink-accepting (oleophilic) and ink-repellent (oleophobic) surface areas. Ink is retained on the oleophilic regions and rejected where the plate is oleophobic. In a dry printing system, the plate is simply inked and the image transferred onto a recording material; the plate first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to or in conjunction with inking. The ink-repellent fountain solution prevents ink from adhering to the non-image areas, but does not affect the oleophilic character of the image areas.

Both dry and wet lithographic printing plates generally comprise a printing surface disposed on some form of support, which may or may not contribute to the pattern of ink receptivity and rejection. For example, as disclosed in U.S. Pat. No. 5,339,737, laser-imageable lithographic printing constructions may include a first, topmost layer chosen for its affinity for (or repulsion of) ink or an ink-adhesive fluid; an imaging layer, which ablates in response to imaging (e.g., infrared, or "IR") radiation, thereunder; and beneath the imaging layer, a strong, durable substrate characterized by an affinity for (or repulsion of) ink or an ink-adhesive fluid opposite to that of the first layer. Ablation of the imaging layer weakens the topmost layer as well. By disrupting its anchorage to an underlying layer, the topmost layer is rendered easily removable in a post-imaging cleaning step, creating an image spot having an affinity for ink or an ink-adhesive fluid differing from that of the unexposed first layer. In this type of construction, as with many traditional photoexposure-type designs, the substrate is a heavy polymeric film that accepts ink and confers needed strength and durability to the construction. The price of these qualities, however, is material cost and the manufacturing capacity for handling such films.

U.S. Pat. Nos. 5,783,364 and 5,807,658 disclose wet and dry lithographic printing members that include metallic inorganic layers. These layers exhibit both hydrophilicity and substantial durability at very thin application levels, and ablatively absorb imaging radiation, thereby facilitating direct imaging without chemical development. They can also be used to form optical interference structures which, in addition to providing color, likewise absorb imaging radiation and ablate in response to imaging pulses. Wet lithographic printing members based on this concept may include a protective layer that provides protection against handling and environmental damage, extends plate shelf life, and entrains debris generated by ablation. The layer washes away during the printing make-ready process, effectively cleaning the plate and disappearing without the need for a separate removal process. Once again, however, these printing members contemplate heavy polymeric substrates.

Some applications require greater dimensional stability than can be conferred by a plastic film. One such application involves special types of web presses, typically used by publishers of newspapers, that do not provide clamping mechanisms to retain printing plates against the plate cylinders. Instead, the leading and trailing edges of each the plate are crimped and inserted into a slot on the corresponding cylinder, so the plate is held against the surface of the cylinder by the mechanical flexion of the bent edges. Film or plastic materials cannot readily provide the necessary shape retention and physical strength to accommodate use in such presses. For example, while it may be possible to produce relatively permanent bends in a polyester substrate using heat-set equipment, such an approach may prove cumbersome and costly. For these applications, the plastic film substrate is typically laminated to a heavy-duty metal support as described, e.g., in U.S. Pat. No. 5,188,032 (the entire disclosure of which is hereby incorporated by reference).

Metal sheets may also be employed directly as substrates, as is typically done with large-sized plates. The dimensional stability of plastic- or film-based plates tends to decrease with size unless the thickness of the substrate is increased; however, depending on the size of the plate, the amount of thickening necessary to retain acceptable rigidity can render the plate unwieldy, uneconomical or both. By contrast, metal substrates can provide high degrees of structural integrity at relatively modest thicknesses.

Metal supports or substrates are, of course, more expensive than their plastic counterparts, and require specialized, heavy-duty processing equipment. Although substantially intact after even long print runs, they are part of the plate structure, integrally bound to the remaining plate layers, and therefore cannot be reused.

DESCRIPTION OF THE INVENTION

Brief Summary of the Invention

In accordance with the present invention, provision is made for re-use of the plate substrate or support, which may be a metal sheet affixable (e.g., by crimping or using clamps) to a plate cylinder, or may instead be the permanent surface of such a cylinder. In this way, the traditional "plate" is replaced with a thin, easily manufactured printing member, which is separated from the support following its use. In one approach, the printing member has a printing structure for accepting a lithographic printing pattern, and beneath the printing structure, a layer of adhesive. When the printing member is applied to the metal surface of a plate cylinder or other support, the adhesive holds the printing member against the support with enough strength to prevent relative movement therebetween during printing; in this way, registration among printing members associated with separate printing stations (which sequentially encounter the recording medium to which ink is applied) remains intact. When the printing job is done, the printing member is peeled from the support and recycled or discarded. In other words, notwithstanding the strength of the adhesive in maintaining registration, it does not prevent the printing member from being peeled from the support, preferably without substantial residue thereon.

It should be emphasized that the printing member may be in the traditional form of a cut sheet, or may instead be provided in some other form, e.g., as a roll that is applied to the support in sections. For example, such a roll might be contained within the interior of the cylinder and wound in increments around the exterior surface as print jobs are completed; see, e.g., U.S. Pat. No. 5,355,795.

In another embodiment, the adhesive is heat-responsive, losing adhesion with increasing temperature. The adhesive-backed member is applied to the support (and, if necessary, heated and then cooled to cause adhesion), whereupon printing may be carried out in the usual fashion. To facilitate removal of the member, the support is heated. Preferably, the surface of the support and the printing-member layer bearing the adhesive are chosen such that, upon heating, the adhesive is better retained by the member so as to minimize residue on the support.

In a third embodiment, the printing member is held onto the exterior surface of a porous cylindrical support (e.g., the plate cylinder of a lithographic printing press) by negative pressure; that is, a vacuum applied to the interior of the cylinder is communicated through radial pores, thereby retaining the member (generally in the form of a sheet) against the exterior cylinder surface. Because the members used in connection with this embodiment of the invention are typically quite thin (e.g., on the order of 0.001–0.002 inch), it is necessary to utilize a cylinder configuration specifically adapted to avoid deforming the retained member; for example, conventional vacuum plate-retention systems typically have widely spaced, relatively large-diameter air passages that would create depressions on the printing-member surface, resulting in uneven printing. The present invention therefore makes use of cylinders having continuous, uniform distributions of small-diameter pores contiguous over the surface of the cylinder (or at least that portion of the cylinder underlying the image portion of the member), thereby creating a highly uniform retention force and avoiding pressure concentrations that might cause surface depressions. Following printing, positive pressure may be used to facilitate removal of the used printing member.

BRIEF DESCRIPTION OF THE DRAWINGS

The foregoing discussion will be understood more readily from the following detailed description of the invention, when taken in conjunction with the accompanying drawings, in which.

Figure 1:
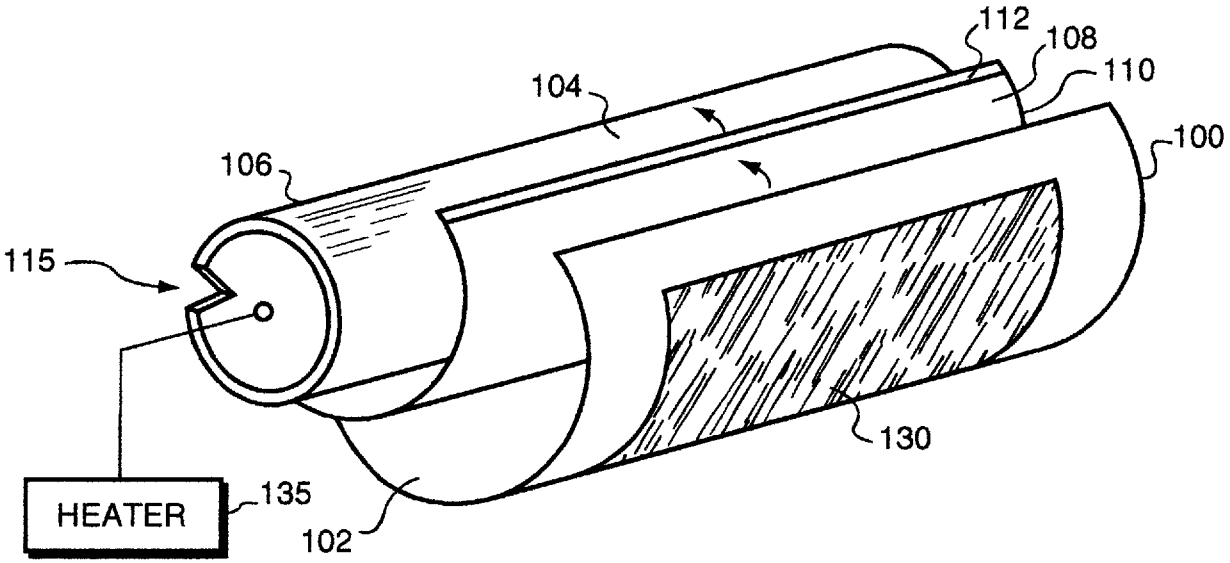
FIG. 1 is an exploded isometric view of a representative embodiment of the invention, showing the manner in which a printing member is mounted to a cylindrical support either directly or by means of a metal carrier, which is itself clamped to the cylinder.

The drawings and components shown therein are not necessarily to scale.

DETAILED DESCRIPTION OF THE PREFERRED EMBODIMENTS

The printing members utilized in connection with the present invention may take many forms, and are not restricted in terms of type or construction. For example, suitable members range from traditional photoexposure constructions to members imaged, ablatively or otherwise, by laser or spark discharge. Suitable members imaged by laser discharge are disclosed, for example, in U.S. Pat. Nos. 5,339,737 and 5,379,698 (the entire disclosures of which are hereby incorporated by reference). Representative constructions include three-layer members having an oleophobic (for dry printing) or hydrophilic (for wet printing) surface layer; a thin-metal or polymeric imaging layer, which ablates in response to laser imaging pulses, thereunder; and a non-ablative, oleophilic (ink-accepting) substrate beneath the imaging layer. Two-layer members utilize oleophobic or hydrophilic surface layers ablatable by laser discharge, and oleophilic substrates thereunder that do not ablate.

In another preferred approach, the member comprises a surface layer based on certain metallic materials, and an oleophilic layer thereunder. The metallic materials are both hydrophilic and durable, making them desirable for wet-plate constructions. In one version, the material is a very thin (50–500 Å, with 300 Å preferred for titanium) layer of a metal that may or may not develop a native oxide surface upon exposure to air. This layer ablates in response to IR radiation, and an image is imposed onto the member through patterned exposure to the output of one or more lasers (as disclosed, for example, in U.S. Pat. No. 5,385,092, the entire disclosure of which is hereby incorporated by reference). The metal is preferably at least one d-block (transition) metal, aluminum, indium or tin; in the case of a mixture, the metals are present as an alloy or an intermetallic. The oleophilic layer can also be treated in various ways to improve adhesion to the metal layer. For example, plasma treatment of a film surface with a working gas that includes oxygen (e.g., an argon/oxygen mix) results in the addition of oxygen to the film surface, improving adhesion by rendering that surface reactive with the metal(s) Oxygen is not, however, necessary to successful plasma treatment. Other suitable working gases include pure argon, pure nitrogen, and argon/nitrogen mixtures. See, e.g., Bernier et al., *ACS Symposium Series* 440*, Metallization of Polymers*, p. 147 (1990).

Alternatively, the member may contain a metallic inorganic layer above the metal layer. The inorganic layer may comprise a compound of at least one metal with at least one non-metal, or a mixture of such compounds. Along with the underlying metal layer, the inorganic layer ablatively absorbs imaging radiation, and consequently is applied at a thickness of only 100–2000 Å. The metal component of the inorganic layer may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component may be one or more of the p-block elements boron, carbon, nitrogen, oxygen and silicon. A metal/non-metal compound in accordance herewith may or may not have a definite stoichiometry, and may in some cases (e.g., Al—Si compounds) be an alloy. Preferred metal/non-metal combinations include TiN, TiON, $TiO_x$ (where $0.9 \leqq x \leqq 2.0$), TiAlN, TiAlCN, TiC and TiCN.

In wet-plate embodiments where the metallic or metallic inorganic layer represents the uppermost surface layer, the member may also include a protective layer applied thereover. This layer preferably comprises a polyalkyl ether compound with a molecular weight that depends on the mode of application and the conditions of plate fabrication. For example, when applied as a liquid, the polyalkyl ether compound may have a relatively substantial average molecular weight (i.e., at least 600) if the plate undergoes heating during fabrication or experiences heat during storage or shipping; otherwise, lower molecular weights are acceptable. A coating liquid should also exhibit sufficient viscosity to facilitate even coating at application weights appropriate to the material to be coated.

A preferred formulation for aqueous coating comprises 80 wt % polyethylene glycol (PEG) with an average molecular weight of about 8000 combined with 20 wt % hydroxypropyl cellulose to serve as a thickener. A formulation according to this specification was prepared by combining 4.4 parts by weight ("pbw") of Pluracol 8000 (supplied by BASF, Mt. Olive, N.J.) with 1.1 pbw of Klucel G or 99-G "FF" grade hydroxypropyl cellulose (supplied by the Aqualon division of Hercules Inc., Wilmington, Del.). The ingredients were blended together as dry powders and the mixture slowly added to 28 pbw of water at 50°–55° C. with rapid agitation, allowing the powders to be wetted between additions. The mixture was stirred for 20–30 min. while maintaining the temperature between 50°–55° C., thereby wetting the Klucel particles and dissolving the Pluracol. At this point 66.5 pbw of cold water (ca. 5°–10° C.) was added all at once, bringing the mixture temperature close to or below room temperature. Stirring was continued for 1–2 hours until solution was complete. The fluid viscosity was measured at about 100 cp.

Other materials and formulations can be used to advantage. For example, the polyalkyl ether can be replaced with a polyhydroxyl compound, a polycarboxylic acid, a polysulfonamide or a polysulfonic acid or mixtures thereof. Gum arabic or the gumming agents found in commercial plate finishers and fountain solutions can also be used to provide the protective layer. The TRUE BLUE plate cleaning material and the VARN TOTAL fountain solution supplied by Varn Products Company, Oakland, N.J. are also suitable for this purpose, as are the FPC product from the Printing Products Division of Hoescht Celanese, Somerville, N.J., the G-7A-"V"-COMB fountain solution supplied by Rosos Chemical Co., Lake Bluff, Ill., the VANISH plate cleaner and scratch remover marketed by Allied Photo Offset Supply Corp., Hollywood, Fla., and the the POLY-PLATE plate-cleaning solution also sold by Allied. Still another useful finishing material is polyvinyl alcohol, applied as a very thin layer.

The protective layer is preferably applied at a minimal thickness consistent with its roles, namely, providing protection against handling and environmental damage, extending plate shelf life by shielding the plate from airborne contaminants, and entraining debris produced by imaging. The thinner the protective layer can be made, the more quickly it will wash off during press make-ready, the shorter will be the roll-up time, and the less the layer will affect the imaging sensitivity of the plate.

In preferred constructions of the present invention, the member includes a substrate layer that is thinner than conventional substrates. For example, it is possible to utilize polyester film, a typical ink-receptive material used in lithographic plate constructions, in thicknesses of 0.001 inch or greater, with preferred thicknesses ranging from 0.001 to 0.002 inch. Of course, larger and smaller gauges may be appropriate to different applications; for example, stronger polymeric materials may be used at smaller thicknesses.

Refer to FIG. 1, which illustrates the basic approach of the invention to adhesive affixation of a thin printing member to a reusable surface. A printing member 100, which includes an adhesive backing 102, is applied either directly to the exterior surface 104 of a cylindrical support (e.g., a stainless-steel or aluminum plate cylinder) 106, or instead to a surface 108 of a metal (e.g., stainless steel) carrier 110 that itself attaches to the cylinder 106. For example, the carrier 110 may have a pair of marginal tabs (one of which is shown at 112) that are received by slots in cylinder 106, or by conventional clamps located within a cylinder void segment 115.

Figure 2:
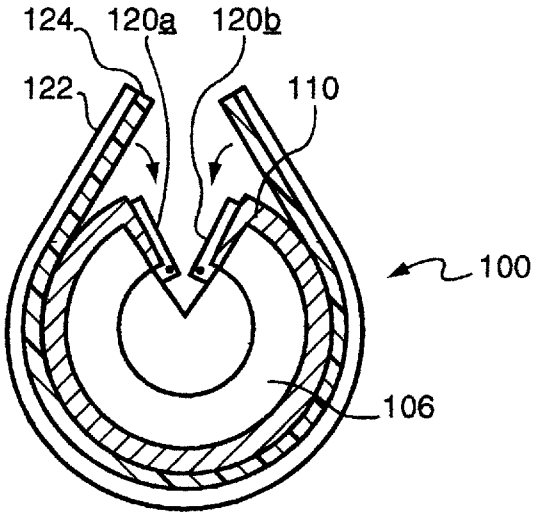
FIG. 2 is an end view of a lithographic printing structure having an adhesive layer, and a carrier and cylinder assembly to which the printing structure is adhered in accordance with the invention.

This is shown more clearly in FIG. 2, which also illustrates the characteristics of member 100 in greater detail. The marginal tabs of carrier 110 are received in a pair of clamps 120*a*, 120*b*. The member 100 comprises a printing structure, indicated generically at 122, and an adhesive layer 124. The printing structure 122 may comprise a plurality of cooperative layers which, in response to actinic radiation or imaging (e.g., IR) laser pulses—and, if necessary, subsequent processing—assume an imagewise pattern of regions exhibiting differential affinities for ink and/or fountain solution. Typically, as shown in FIG. 1, the printing area 130 of the member 100—that is, the portion of the member surface that actually receives the imagewise pattern—is a subregion of the overall member surface.

In first and second embodiments, shown generally in FIG. 2, the printing member 100 comprises a printing structure 122 for accepting a lithographic printing pattern, and beneath the printing structure, a layer 124 of adhesive. In the first embodiment, member 100 may be applied to the metal surface of a plate cylinder or other support. The adhesive layer 124 is pressure sensitive, and holds the printing member against carrier 110 (or the surface of cylinder 106) with enough strength to prevent relative movement therebetween during printing. The adhesive is nonetheless weak enough to permit member 100 to be peeled from carrier 110 when the printing job is done, preferably without leaving any substantial residue. Useful adhesives also resist the action of the chemical reagents (such as fountain solution, plate cleaners and/or ink solvents) typically encountered during printing.

Suitable adhesives for this purpose include acrylic materials, such as those formulated for repeated applications and removals. Since the surface area of member 100 is so large, bulk relative movement will be substantially prevented by even moderate forces of adhesion. In one exemplary version of this embodiment, the 4560 double-coated polyester film tape supplied by International Tape Co., Windham, N.H. was applied to the back (polyester) surface of a wet lithographic printing plate (with the permanent-bonding surface of the tape against the polyester layer), and the composite construction applied to a plate cylinder in a four-color lithographic printing press; printing with the plate was found not to disrupt registration. The low-tack side of the 4560 product (which contacts the carrier or plate cylinder) is an acrylic adhesive having an adhesion value of 16 oz./in. width and a tack value of 4.0". In commercial practice, however, it is generally preferable to apply the adhesive as a single coat beneath the bottom layer of printing structure 122; the member, as supplied, has a backing liner beneath adhesive layer 124, and which the user removes just prior to application. Nonetheless, use of a double-sided material is not without benefit; because of the thickness of the tape (approximately 0.004 inch), the plate to which the 4560 product had been applied—a Ti/TiN plate in accordance with the '287 application—was found to exhibit good scratch resistance. Accordingly, it is possible to use the adhesive as a deformable layer to prevent scratches in accordance with U.S. Pat. No. 5,704,291, the entire disclosure of which is hereby incorporated by reference.

Successful results were also acheived using the 550 double-coated polyester film tape supplied by International Tape Co., applied to the back surface of a wet printing plate. The low-tack side of this product has an adhesion value of 10 oz./in. width and a tack value of 4.0". The chemical resistance of this version, however, may be inadequate for long runs.

In a second embodiment, adhesive layer 124 is a heat-responsive material. When applied (either directly or following a heating and cooling cycle), the adhesive retains member 100 against carrier 110 (or the exterior surface of cylinder 106) with sufficient strength to prevent relative movement therebetween during printing, but releases upon heating of the surface to which it is applied. Accordingly, cylinder 106 has associated therewith a selectably actuable heating unit 135, which heats the exterior surface of the cylinder (and, by conduction, carrier 110 if used) or other plate-bearing device to a sufficient temperature to allow convenient removal of member 100. Preferably, the adhesive is formulated (and/or the bottom surface of printing structure 122 is treated) such that the adhesive preferentially adheres to printing structure 122 rather than to carrier 110 or to the surface of cylinder 106.

The heat-responsive adhesive 124 may be a polyurethane, a polyamide (or copolyamide), an ethylene vinyl acetate, a polysilane (which may be applied, for example, by plasma activation of a polyester surface prior to depositing hexamethyldisiloxane), or any other heat-responsive material that loses internal cohesion at convenient operating temperatures ranging from, for example, 200°–350° F. To encourage the adhesive to remain primarily on printing structure 122 during removal thereof, the bottom surface of printing structure 122 may be treated. Typically, treatment involves roughening the surface, increasing adhesion thereto through creation of a three-dimensional topology. In one approach, the bottom layer of printing structure 122 is polymeric (e.g., polyester), and the bottom surface is treated by plasma discharge. Of course, other forms of roughening (e.g., by mechanical means) may be better suited to other materials or in different applications, and the skilled practitioner can readily identify the most appropriate technique without undue experimentation. Alternatively, a "tie" coat, which exhibits an affinity for the heat-responsive adhesive, is applied to the bottom surface of printing structure 122, and the adhesive is applied to the tie coat. Titanium metallization provides an advantageous tie coat for a variety of adhesive materials.

For this embodiment, it is especially preferred to utilize a polished or unpolished stainless-steel carrier 110 (or cylinder 106) so as to minimize affinity for the heated adhesive. However, as another alternative (or in addition to treatment of printing structure 122), cylinder 106 or carrier 110 may be treated to encourage release. For example, a plasma may be applied to the metal surface to remove oils, after which the surface is coated with a fluoropolymer or silane by plasma deposit (e.g., through plasma activation of decomposable siloxanes such as hexamethyldisiloxane).

Figure 3:
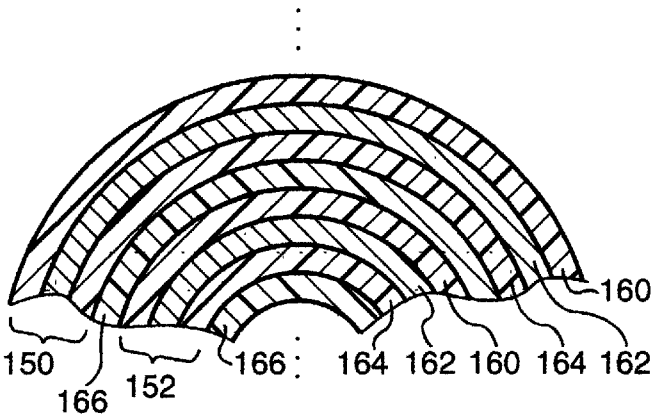

Printing structures in accordance with the first and second embodiments may be designed for manufacture and use in roll form. FIGS. 3–6 illustrate, in greater detail, suitable constructions that lend themselves to this type of arrangement. FIG. 3 shows two adjacent spiral winds 150, 152 of a dry printing structure utilizing a surface that also serves as a release layer. The printing structure shown at 150, 152 comprises an ink-adhesive silicone or fluoropolymer first layer 160; an imaging layer 162 (e.g., a thin metal such as titanium applied at 200 Å or less, in accordance with the '698 patent, or a polymeric layer as described in the '737 patent) that ablates in response to imaging radiation; and an ink-receptive base 164, which may be, for example, polyester film having a thickness of 0.001 inch or less. A pressure-sensitive adhesive layer 166 underlies base 164. Adhesive layer 166 does not adhere to layer 160, which thereby provides a release surface that enables layers 160–166 to be continuously unrolled. Once again, adhesive layer 166 can be designed to provide cushioning in accordance with the '291 patent.

Figure 4:
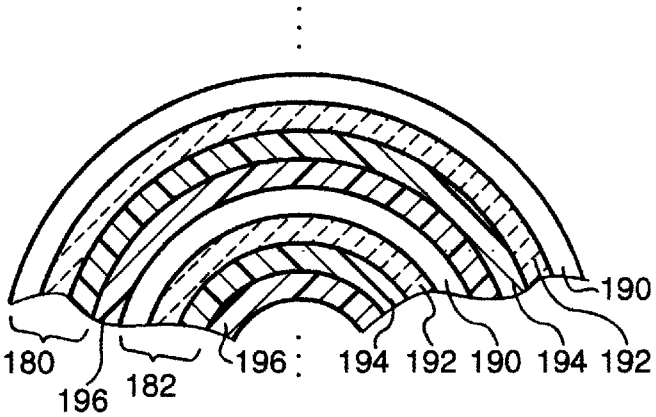
FIGS. 3–6 are sectional views of rolled printing constructions in accordance with the present invention.

FIG. 4 shows two adjacent spiral winds 180, 182 of a wet printing structure utilizing the approach of the '658 patent. The printing structure comprises a hydrophilic barrier layer 190, which itself preferably comprises at least one compound selected from the group consisting of polyalkyl ethers, polyhydroxyl compounds, polycarboxyl acids, polysulfonamides and polysulfonic acids; a refractory hydrophilic layer 192 that comprises a compound of at least one metal with at least one non-metal, the at least one non-metal being selected from the group consisting of boron, carbon, nitrogen, silicon and oxygen (e.g., titanium nitride, or titanium nitride over titanium), and which ablates in response to imaging radiation; and an ink-receptive base 194, which may be, for example, polyester film having a thickness of 0.001 inch or less. A hot-melt adhesive layer 196 underlies base 194. The adhesive exhibits no substantial tack until it is heated, and therefore does not adhere to layer 190 at room temperature; once again, the lack of adhesion permits layers 190–196 to be continuously withdrawn from the roll.

The absence of tack is not absolute, however, and most hot-melt adhesives can be expected to leave some minor residue on layer 190. But this layer is expressly formulated to wash away during the printing make-ready process, effectively cleaning the plate and disappearing, along with the entrained adhesive residue.

Figure 5:
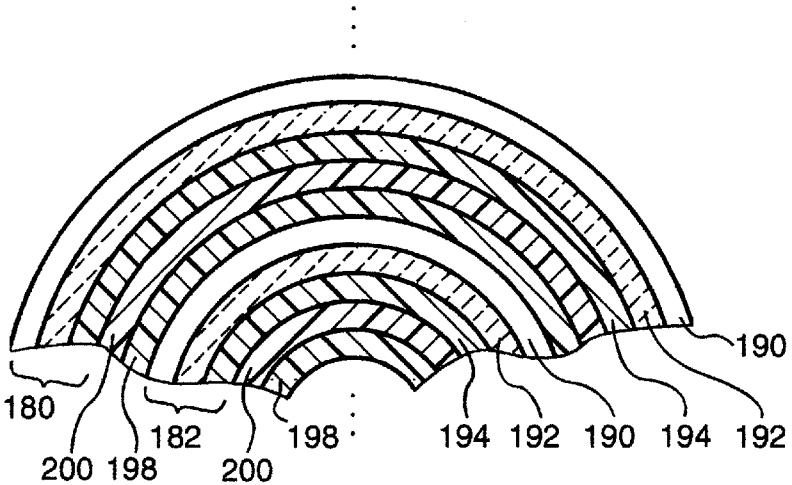

FIG. 5 shows an alternative to the embodiment of FIG. 4, which includes a release liner 198. This liner facilitates the use of virtually any adhesive desired in the adhesive layer 200. Liner 198 may be, for example, a polyester coated with silicone on the side in contact with adhesive layer 200; the uncoated side, rolled into contact with layer 190, will not adhere to that layer. Alternatively, liner 198 may be any other inert material that interacts neither with adhesive layer 200 nor protective layer 190. It should be noted that protective layer 190 is optional in this construction and can, if desired, by omitted.

Although this approach requires removal of the release liner prior to lamination (or other attachment) to a metal support, the approach is highly general, and may be applied to a variety of different types of printing constructions. For example, it is possible to apply layers 198, 200 to a wet-plate construction in accordance with the '737 patent; such a construction may include a polyvinyl alcohol or other hydrophilic, polymeric material as a surface layer; an imaging layer (e.g., a thin metal or polymeric layer as described above) that ablates in response to imaging radiation; and an ink-receptive (e.g., polyester base). The adhesive layer 200 is permanently applied to the underside of the polyester layer (although removable from the support to which the construction is applied, as described hereinabove), and release liner 198 underlies the adhesive layer 200.

Figure 6:
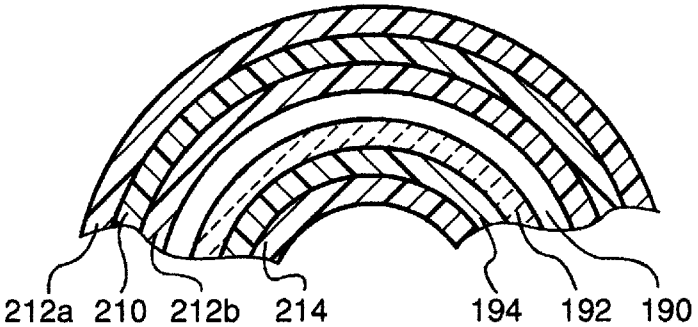

Refer now to FIG. 6, which shows one wind of a rollable printing construction that also utilizes a release material, but which unrolls with the adhesive layer exposed. The illustrated construction includes a protective hydrophilic layer 190 and a refractory hydrophilic layer 192, and includes a temporary support 210 on which the other layers are built up. Support 210 may be an inexpensive paper sheet or a polymeric material, and desirably may also be recycled. A release layer 212*a*, 212*b* may be applied to each side of support 210. The function of layer 212*a* is to prevent adhesion to an adhesive layer 214, and layer 212*a* may therefore be omitted depending on the nature of support 210 (or if a layer 214 is a hot-melt adhesive). The function of layer 212*b* is to allow support 210 to be stripped from layer 190 following application of the construction to a support. In one approach, layer 212*b* is a silicone release layer formulated for controlled release. Alternatively, layer 212*b* may be a heat-activated substance, such as a wax; the carnauba wax coatings used in hot-stamping foil applications, for example, represent suitable materials.

Although solid at room temperature, the wax liquefies when heated, facilitating removal of support 210. Because layer 190 is hydrophilic, it is desirable that release layer 212*b* exhibit some hydrophilicity as well. Indeed, if the wax is sufficiently hydrophilic, it may serve, as a single layer, the functions of both layer 212*b* and 190.

Support 210 serves as a manufacturing substrate for the construction. Protective layer 190, refractory hydrophilic layer 192, base 194 and adhesive layer 214 are sequentially deposited or coated onto layer 212*b* (or directly onto support 210). In use, adhesive layer 214 is (removably) applied to a metal support, and support 210 stripped away from the construction to permit printing. Any residue of layer 212*b* is entrained within protective layer 190 and washed away during print make-ready.

Figure 7:
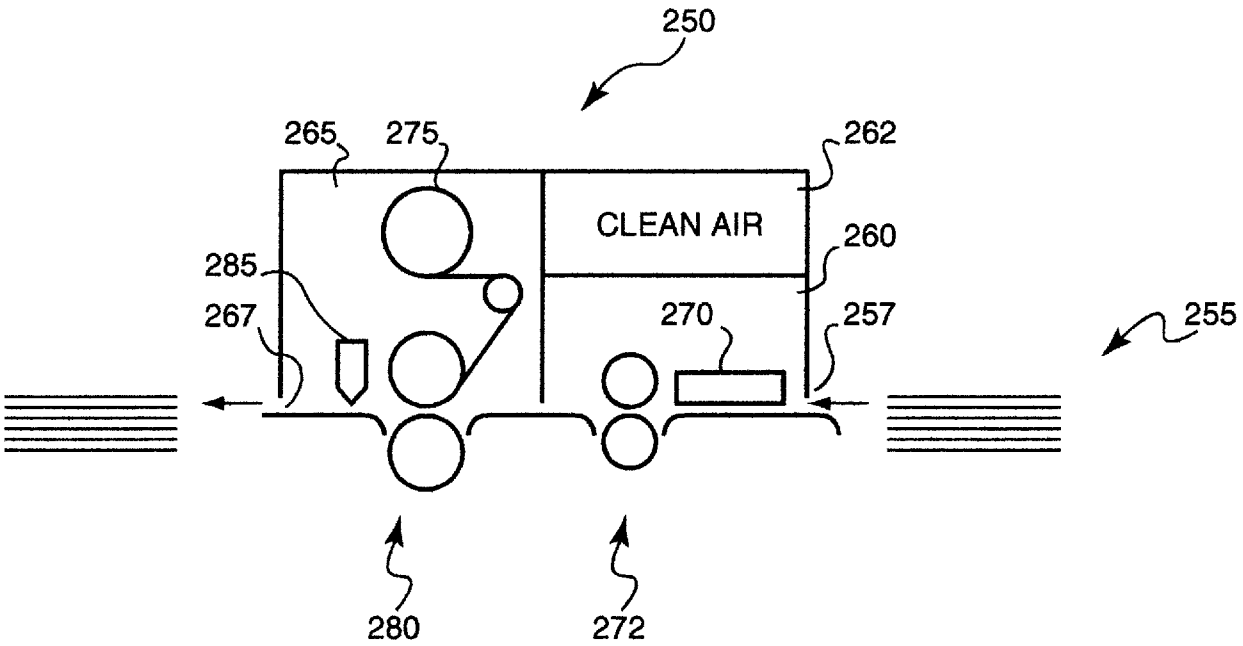
FIG. 7 schematically illustrates an apparatus for applying the constructions shown in FIGS. 3–6 to metal substrates.

FIG. 7 illustrates an apparatus, indicated generally at 250, that can be used to apply plate material in roll form to metal sheets 255 that serve as re-usable supports. A continuous processing path through which sheets 255 successively pass includes an entry 257, a surface-preparation chamber 260, the atmosphere of which is controlled by a source of clean air 262, an application chamber 265, and an exit 267. As sheets pass through preparation chamber 260, they first encounter a surface-processing unit 270. This device may provide for removal of surface debris and/or corona treatment. In addition, unit 270 may sense the presence on sheets 255 of already-used printing constructions, deploying a knife or blade (and, depending on the type of adhesive used, activating a heat lamp as well) to peel the used material off.

A pair of drive rollers 272 form a nip that feeds sheets 255 to application chamber 265. Located in chamber 265 is a cassette or roll 275 of adhesive-backed plate material in accordance with the present invention. The plate material 275 feeds into the nip of a pair of application rollers 280 (which may be heated if hot-melt adhesive is used). Rollers 280 apply plate material 275 to sheets 255, and the material 275 is cut to length by a blade 285. The finished plates leave apparatus 250 through exit 267.

Figure 8:
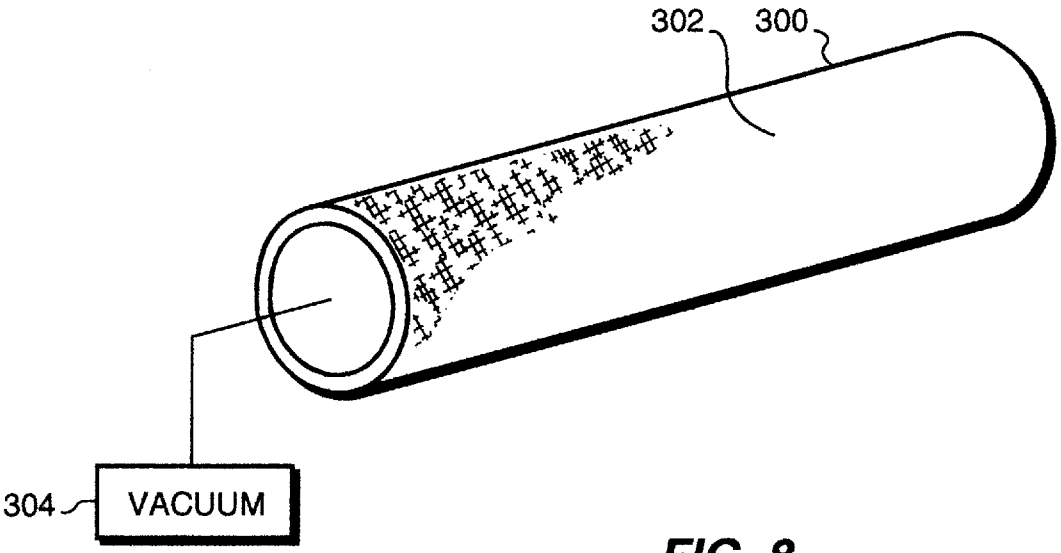
FIG. 8 is an isometric view of a porous cylinder to which a printing structure may be attached by means of negative pressure.

In a third embodiment of the present invention, the printing structure itself is directly attached to a porous cylinder by means of negative pressure. A suitable configuration is shown in FIG. 8. The illustrated cylinder 300 has a continuous, uniform distribution of small-diameter pores contiguous over its surface 302 (or at least that portion of surface 302 underlying the image portion of a member applied thereto). The body of cylinder 300 is sealed and a vacuum pump 304, which may be located within cylinder 300 or externally (but in sealed fluid communication with the interior of cylinder 300), evacuates air from the cylinder interior to create a negative pressure that holds a printing structure wrapped around surface 302 with sufficient force to prevent its circumferential movement; pump 304 may also operate in reverse to assist initial positioning of the printing structure and its removal following use.

The cylinder 300 may be any type of structure having the requisite porosity and resistance to deformation. The optimal size of the pores and their density for a particular application are determined by the thickness and rigidity of the printing structure 122 that is applied thereto, as well as by the need for sufficient air transfer to produce an adequate negative pressure. Generally, the pores are less than 1 mm in diameter, and may be substantially smaller than this. For example, tubular materials furnished by Mott Metallurgical Corp. have uniformly distributed pores whose average size may be on the order of 1 micron or less. The Membralox Division of U.S. Filter Corp. offers multichannel ceramic membranes, and Rhone-Poulenc offers ceramic and silicon-carbide membrane elements. Pall Filter Corp. sells ceramic, silicon carbide, and porous metal sheet and tubular constructions similar to those of the other manufacturers. Sintered metals with variable pore sizes are also widely available. Any of these may be used directly, or as outer layers around a metal mesh skeleton (or conventionally perforated tube) for support.

In use, the printing member (actually, printing structure 122) is wrapped around the surface 382 of cylinder 300, and vacuum pump 304 is activated until a vacuum corresponding to sufficient retention strength is achieved. Preferably, vacuum pump 304 is equipped with suitable feedback circuitry that automatically terminates pumping when a user-selectable retention strength is reached, reactivating pump 304 only as necessary to maintain this level. Following printing, the interior of cylinder 300 is vented, facilitating ready removal of the printing structure.

It will therefore be seen that the foregoing represents an improvement to lithographic printing systems in providing reusable application surfaces. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of printing comprising the steps of:

a. providing a printing member in rolled form, the member comprising a printing structure for accepting a lithographic printing pattern, the printing structure having (i) a topmost layer, (ii) a bottommost polymeric layer, and (iii) on an exposed side of the bottommost layer, a layer of adhesive for adhering the printing structure to a support sufficiently to prevent relative movement therebetween during printing, the printing structure nonetheless being peelable from the support, the adhesive not exhibiting, substantial adhesion to the topmost layer so that the printing structure, when rolled with the adhesive against the topmost layer, is free to unroll;

b. providing a support for bearing the printing member;

c. unrolling a segment of the printing member from the roll and adhering the segment to the support;

d. printing by applying ink to the printing structure and transferring the ink, in an imagewise pattern, to a recording medium; and e. following the printing step, peeling the printing member from the support.

2. The method of claim 1 wherein the printing structure comprises:

a. a second layer below the topmost layer, the second layer ablating in response to imaging radiation; and b. the topmost and bottommost layers exhibiting different affinities for at least one printing liquid selected from the group consisting of ink and an adhesive fluid for ink.

3. The method of claim 2 wherein:

a. the topmost layer comprises a silicone or a fluoropolymer; and b. the bottommost layer comprises an ink-accepting material.

4. The method of claim 1 wherein the printing structure comprises:

a. the topmost layer being a hydrophilic protective layer;

b. a refractory hydrophilic second layer below the topmost layer, the topmost and second layers ablating in response to imaging radiation; and c. the bottommost layer being ink receptive, the printing member further comprising a support removable from the protective layer.

5. The method of claim 1 wherein the adhesive is an acrylic.

6. The method of claim 1 wherein the printing member further comprises a release liner disposed below the adhesive layer.

* * * * *